US012478118B2

(12) United States Patent
Martinez

(10) Patent No.: US 12,478,118 B2
(45) **Date of Patent: *Nov. 25, 2025**

(54) ADAPTER SYSTEM FOR VEST CLOSURE MECHANISMS

(71) Applicant: Safariland, LLC, Jacksonville, FL (US)

(72) Inventor: Ulysses Martinez, Lakewood, CA (US)

(73) Assignee: Safariland, LLC, Jacksonville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/243,389

(22) Filed: Sep. 7, 2023

(65) Prior Publication Data

US 2024/0206573 A1 Jun. 27, 2024

Related U.S. Application Data

(63) Continuation of application No. 16/992,979, filed on Aug. 13, 2020, now Pat. No. 11,779,064.

(60) Provisional application No. 62/887,830, filed on Aug. 16, 2019.

(51) Int. Cl.

| | |
|---|---|
| ***A41D 13/05*** | (2006.01) |
| ***A45F 3/06*** | (2006.01) |
| *A45F 3/04* | (2006.01) |

(52) U.S. Cl.

CPC ..... *A41D 13/0568* (2013.01); *A41D 13/05* (2013.01); *A41D 13/0562* (2013.01); *A41D 2300/32* (2013.01); *A45F 3/047* (2013.01); *A45F 3/06* (2013.01)

(58) Field of Classification Search

CPC ..... A41D 13/0568; A41D 13/05; A41D 13/0562; A41D 2300/62; A41D 1/04; F41H 1/02

See application file for complete search history.

(56) References Cited

U.S. PATENT DOCUMENTS

| | | | | |
|---|---|---|---|---|
| 5,172,429 | A * | 12/1992 | Lucier | A41F 3/02 2/326 |
| 5,514,057 | A * | 5/1996 | Ciolino | A63B 21/4037 D21/678 |
| 6,240,560 | B1 * | 6/2001 | DeCaro | A41B 9/002 2/67 |
| 8,490,212 | B1 * | 7/2013 | Asher | A41D 1/04 2/2.5 |
| 9,222,757 | B2 * | 12/2015 | Seuk | F41H 1/02 |
| 9,462,833 | B1 * | 10/2016 | Spaulding | A41D 7/005 |
| 9,943,125 | B2 * | 4/2018 | LeMarbe | F41H 1/02 |
| 10,314,355 | B1 * | 6/2019 | Gallo | A45F 5/022 |
| 10,455,869 | B1 * | 10/2019 | Dille | F41H 1/02 |
| 10,893,708 | B1 * | 1/2021 | Burnsed, Jr. | A41D 1/04 |

(Continued)

*Primary Examiner* — Katharine G Kane

(74) *Attorney, Agent, or Firm* — Kane Kessler, P.C.; Paul E. Szabo; Barry E. Negrin

(57) ABSTRACT

A side opening vest includes a front panel and a back panel that are connected by shoulder straps and that are spaced apart from each other defining a left side gap and a right side gap. Straps extend from the back panel across the gaps for connection with the front panel. The front panel has engagement areas for receiving the straps to connect the front and back panels of the garment. The vest includes an adapter system enabling the use of any selected one of a plurality of different closure mechanisms to releasably connect the straps with the front panel.

10 Claims, 9 Drawing Sheets

(56) References Cited

U.S. PATENT DOCUMENTS

2005/0005342 A1* 1/2005 Johnson ..... F41H 1/02 2/102
2005/0005343 A1* 1/2005 Johnson ..... F41H 1/02 2/102
2010/0184349 A1* 7/2010 Hernandez ..... A43B 3/0078 36/50.1
2010/0205708 A1* 8/2010 Storms, Jr. ..... A41D 13/05 2/2.5
2010/0287681 A1* 11/2010 Storms, Jr. ..... F41H 1/02 2/102
2010/0306902 A1* 12/2010 Bourque ..... A41D 27/08 2/244
2011/0023207 A1* 2/2011 Storms, Jr. ..... A45F 5/02 2/102
2012/0018477 A1* 1/2012 Inouye ..... A45F 3/06 224/576
2012/0042439 A1* 2/2012 Dyster ..... A45F 5/02 2/311
2012/0117715 A1* 5/2012 Weafer ..... A41D 13/0015 24/3.1
2012/0132065 A1* 5/2012 Seuk ..... F41H 1/02 89/36.05
2012/0174280 A1* 7/2012 Strum ..... F41H 1/02 24/595.1
2012/0180178 A1* 7/2012 Gallo ..... F41H 1/02 2/2.5
2013/0084764 A1* 4/2013 Swan ..... F41H 1/02 89/937
2013/0139287 A1* 6/2013 Dovner ..... F41H 1/02 2/2.5
2014/0021091 A1* 1/2014 Egli ..... A45C 11/16 206/736
2014/0332572 A1* 11/2014 Buerck ..... A41F 1/00 24/351
2015/0153140 A1* 6/2015 Crye ..... A41F 1/00 2/102
2016/0015096 A1* 1/2016 LeMarbe ..... A41D 13/0568 2/102
2016/0044976 A1* 2/2016 Nykoluk ..... A41D 13/0568 2/2.5
2016/0286939 A1* 10/2016 Spears ..... A45C 13/30
2017/0199011 A1* 7/2017 Beck ..... F41H 5/0471
2017/0234654 A1* 8/2017 Beck ..... F41H 5/04 2/2.5
2017/0238625 A1* 8/2017 Lindquist ..... A41D 13/015
2017/0343320 A1* 11/2017 Storms ..... A41D 1/04
2018/0292177 A1* 10/2018 Roby ..... A41D 13/0512
2019/0041167 A1* 2/2019 Swan ..... F41H 5/013
2019/0090563 A1* 3/2019 Marshall ..... A41D 27/201
2019/0265005 A1* 8/2019 Wellman ..... A41D 13/0153
2019/0307465 A1* 10/2019 Carabajal ..... A61B 17/1322
2019/0313711 A1* 10/2019 Williams ..... A41D 13/0512
2020/0008515 A1* 1/2020 Pellegrino ..... A43B 3/0078
2020/0300582 A1* 9/2020 Becker ..... A41D 13/0012
2021/0212399 A1* 7/2021 Craft ..... A41F 9/025
2022/0110382 A1* 4/2022 David ..... A41D 13/1161

* cited by examiner

ADAPTER SYSTEM FOR VEST CLOSURE MECHANISMS

RELATED APPLICATIONS

Priority is claimed from U.S. patent application Ser. No. 16/992,979 filed Aug. 13, 2020 entitled "Adapter System For Vest Closure Mechanisms".

BACKGROUND OF THE INVENTION

This invention relates to a device such as a garment, in particular, a side opening vest. The vest may be a ballistic vest such as a concealable (soft armor) vest, or a plate carrier, for example. A side opening vest typically has front and back panels that do not directly come together and connect at the user's side but rather leave a gap. Straps of some sort are usually provided to bridge the gaps and/or otherwise connect the front and back panels. The straps typically extend from the back panels and releasably connect with the front panels. In some cases, the straps are portions of a cummerbund whose center portion is secured to the back panel, with the cummerbund end portions wrapping sideways and forward around the user's sides, to the front panel.

In the vest, closure mechanisms are provided to effect the releasable connection between the strap ends and the front panel. After the user dons the vest, the user closes the closure mechanisms to secure the vest in a closed condition about the user's waist. The closure mechanisms can be opened, or released, to enable the user to doff the garment.

Each closure mechanism typically is a two-part mechanism. One part is on the strap end, and it attaches to a second part on an engagement area of the vest front panel. The closure mechanism may take any one of several different forms, such as hook and loop fasteners; a buckle assembly of some type; etc. The closure mechanism may in some cases be configured as a quick release mechanism.

A vest purchaser selects the desired type of closure mechanism in advance, and the selected closure mechanism is installed on the vest at the time of manufacture of the vest. The closure mechanism thereafter cannot be easily removed or altered. A problem with this is that some users would prefer to be able to modify or change the closure mechanism on their vests, after purchase. The present invention addresses that need, by providing an adapter system which enables the user to swap out one type of closure mechanism for another type of closure mechanism without buying a new vest. In addition, the present invention enables the use of one type of closure mechanism on one side of the vest, while having a second, different, type of closure mechanism on the other side of the vest. This feature can in some cases enable quicker donning and doffing of the vest.

The invention is described herein at times as being applicable to a "ballistic vest". By "ballistic vest" is meant a soft armor vest, or a plate carrier, or similar.

SUMMARY OF THE INVENTION

In accordance with one feature of the invention, the engagement area of the vest 12 front panel can include parts of at least two different closure mechanisms. In one embodiment, the two different closure mechanisms are a hook-and-loop closure mechanism, and Molle slots. The engagement area is thus configured to accept and connect with at least two different strap end features—in the illustrated embodiment, either a hook-and-loop patch on the strap end, or a projecting tab on the strap end that fits into the Molle slots. This option on the engagement areas of the front panel is a first mode of variation of the inventive adapter system.

In accordance with another feature of the invention, the strap that extends from the back panel can accept and support at least two different strap end closure parts. As one example, the strap end closure part may be of the type that connects directly to the engagement area of the vest front panel, like a hook-and-loop patch. As another example, the strap end closure part may be of a type that is only one half of an intermediate connector assembly, like a tongue of a buckle assembly. This common strap connector system on the strap end thus provides a second mode of variation of the inventive adapter system.

Thus, the adapter system includes features on the front panel, together with features on the strap ends, that enable at least two different closure mechanisms to be used.

Further features of the invention will become apparent from a reading of the following description of illustrative embodiments of the invention. The invention is not limited to only the illustrated embodiments, but also includes all embodiments that would be apparent to one of ordinary skill in this art.

BRIEF DESCRIPTION OF THE DRAWINGS

The foregoing and other features of the invention will become apparent to one of ordinary skill in the art to which the invention pertains, from a reading of the following specification together with the accompanying drawings, in which.

DESCRIPTION OF AN EMBODIMENT

Figure 1:
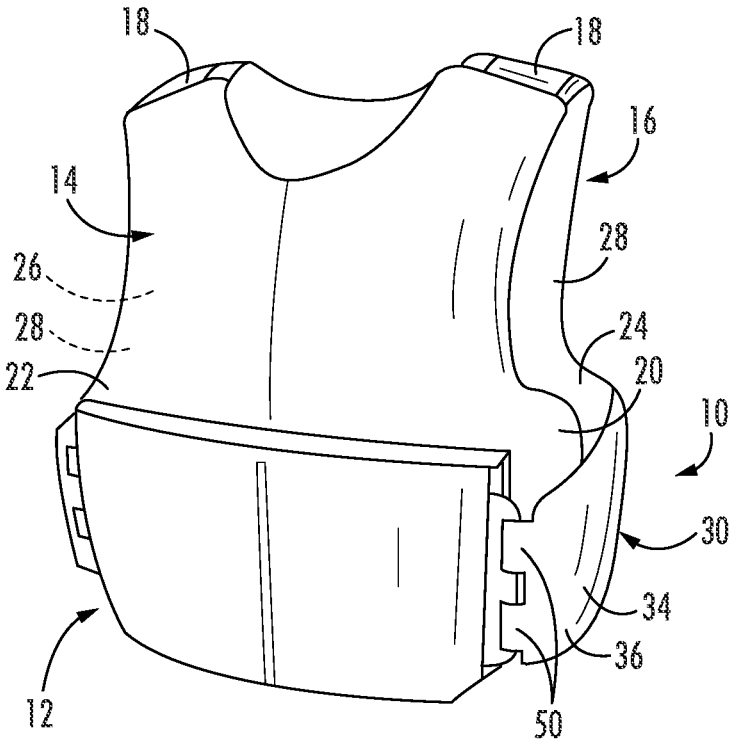
FIG. 1 is a front perspective view of a garment in the form of a vest that includes an adapter system in accordance with a first embodiment of the invention.
Figure 2:
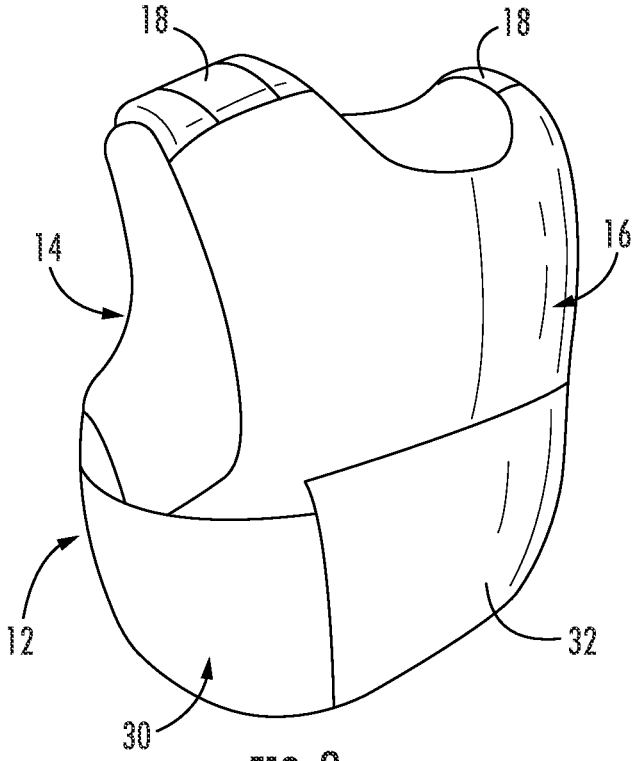
FIG. 2 is a back perspective view of the vest of FIG. 1, showing a cummerbund of the vest.
Figure 3:
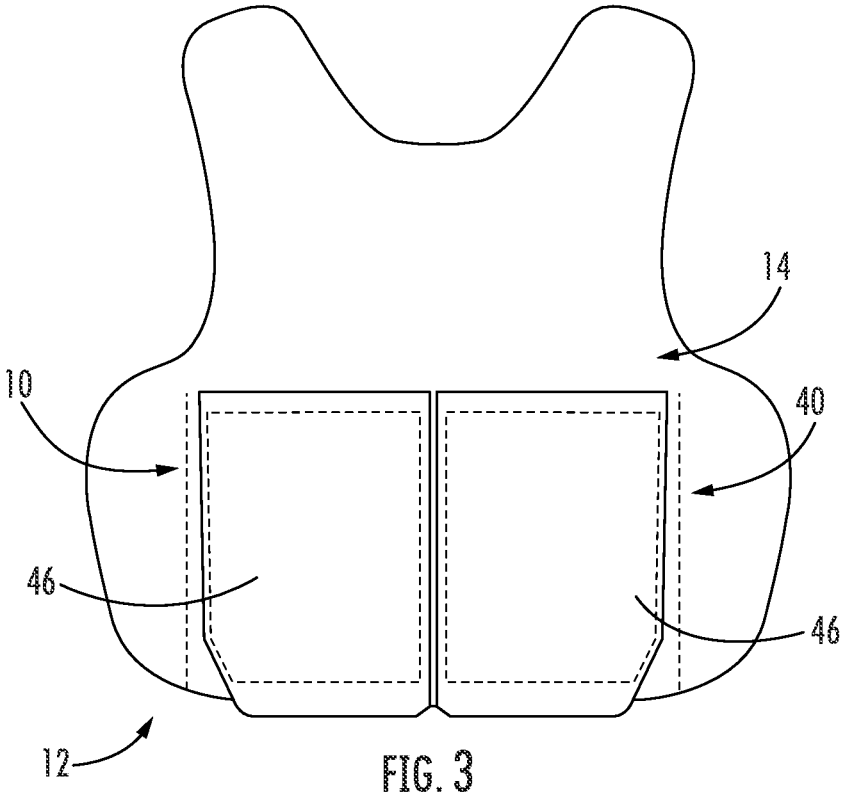
FIG. 3 is a view of a front panel engagement area of the vest of FIG. 1, showing two hook and loop cover flaps in a closed position.
Figure 4:
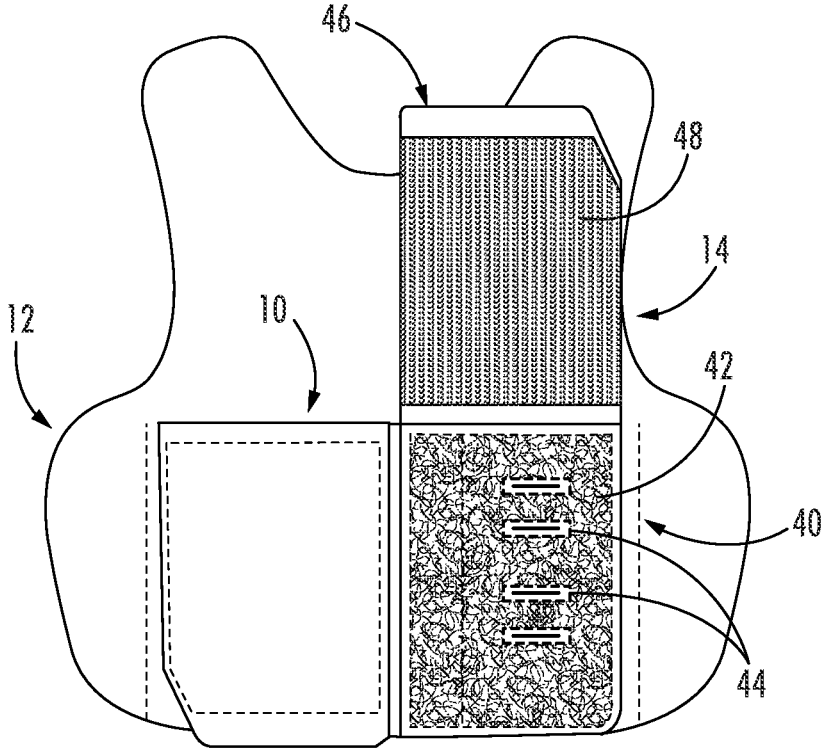
FIG. 4 is a view similar to FIG. 3 showing one hook and loop cover flap in an open position and the other hook and loop cover flap in a closed position.

The drawings illustrate an adapter system 10 that is one embodiment of the invention, shown in use on a vest 12 (FIGS. 1-4). The vest 12 is a side opening vest with a front panel 14 and a back panel 16. Shoulder straps 18 extend between and interconnect the front and back panels 14 and 16.

The front panel 14 has a left side 20 (left on the user) and a right side 22 (right on the user.) The back panel 16 has a left side 24 (left on the user) and a right side 26 (right on the user.) The left side 20 of the front panel 14 is adjacent to the left side 24 of the back panel. The right side 22 of the front panel 14 is adjacent to the right side 26 of the back panel 16.

In the illustrated vest 12, the front and back panels 14 and 16 do not directly come together and connect with each other but rather leave gaps 28 at the vest sides. In other vests or garments that embody the invention, the front and back panels may come together or overlap. A garment like the side opening vest 12 does need some means of connecting (securing) the front panel to the back panel. The adapter system 10 is used in that regard.

The illustrated vest 12 includes a cummerbund 30 (FIG. 2) to help secure the front panel 14 to the back panel 16. A central portion 32 of the cummerbund 30 is secured to the back panel 16. Straps 34 of the cummerbund wrap 30 sideways and forward around the user's sides, across the gaps 28, to the front panel 14, where strap end portions 36 can be engaged with and secured to the front panel in a manner as described below. (Vests usually close on the front panel, for convenience; the present invention is applicable to vests that close on the back panel, alternatively.) The straps 34 of the cummerbund 30 thus bridge the gaps 28 and help to connect the front and back panels 14 and 16. As an alternative to the cummerbund, some vests have straps that are integral to the back panel.

The front panel 14 (FIGS. 3 and 4) has an engagement area 40 on each side, as described below in detail. The two engagement areas 40 on the front panel 14 are mirror images of each other (left and right) and so only one will be described in detail. Similarly, the strap end portions 36 are mirror images of each other, so only one will be described in detail. The engagement areas 40, as part of the adapter system 10, are configured to engage the closure mechanism on the strap end portions 36 of the cummerbund 30. As described below, the adapter system 10 includes ways to attach various different closure mechanism to the strap end portions 36, for engagement with the engagement areas 10.

Each vest front panel engagement area 40 includes a patch 42 of outwardly facing loop material (for making a hook and loop connection). Within the area of that loop patch 42, the vest front panel 14 has a number of fastening slots 44 that extend completely through the front panel 14 between outside and inside, including through the patch of hook material. The fastening slots 44 extend horizontally on the vest front panel 12. The loop patch 42 and the fastening slots 44 constitute two different front panel 14 closure mechanism parts, as described below in detail.

A covering flap 46 is pivotally mounted, on the front panel 14, above the loop patch 42. The covering flap 46 is pivotable about its upper edge so that when it is open it allows access to the loop patch 42, and when closed it covers the loop patch 42. The inside of the covering flap 46 carries a patch 48 of hook material. The flap 46, when it is folded down to overlie the loop patch 42, is releasably secured to the loop patch 42 by the hook and loop connection that is formed. The covering flap 46 thus securely covers both the loop patch 42 and the fastening slots 44, and helps to secure any fastener part that may be mounted between the covering flap and the hook patch, in that engagement area 40.

Figure 5:
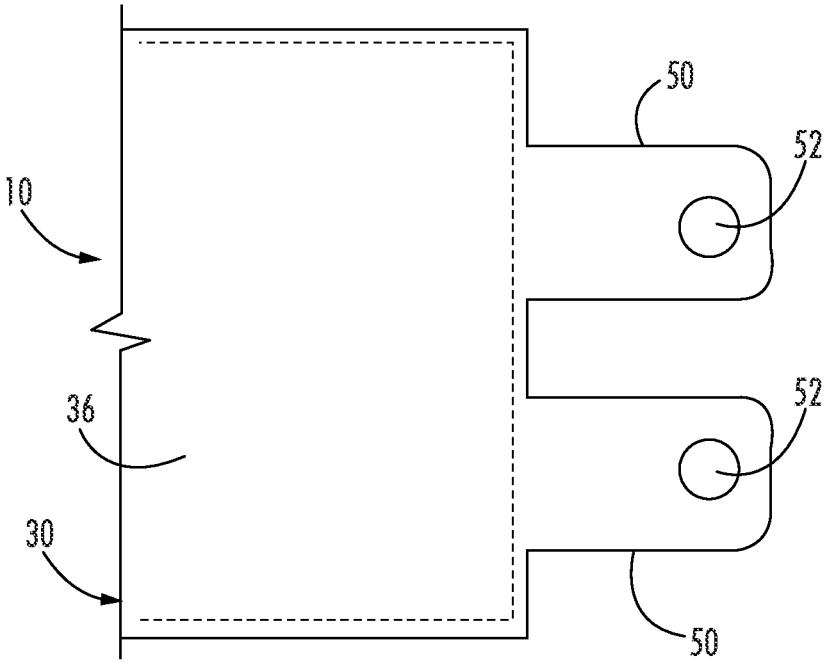
FIGS. 5 and 6 illustrates front and back faces of strap end portions on the cummerbund.
Figure 6:
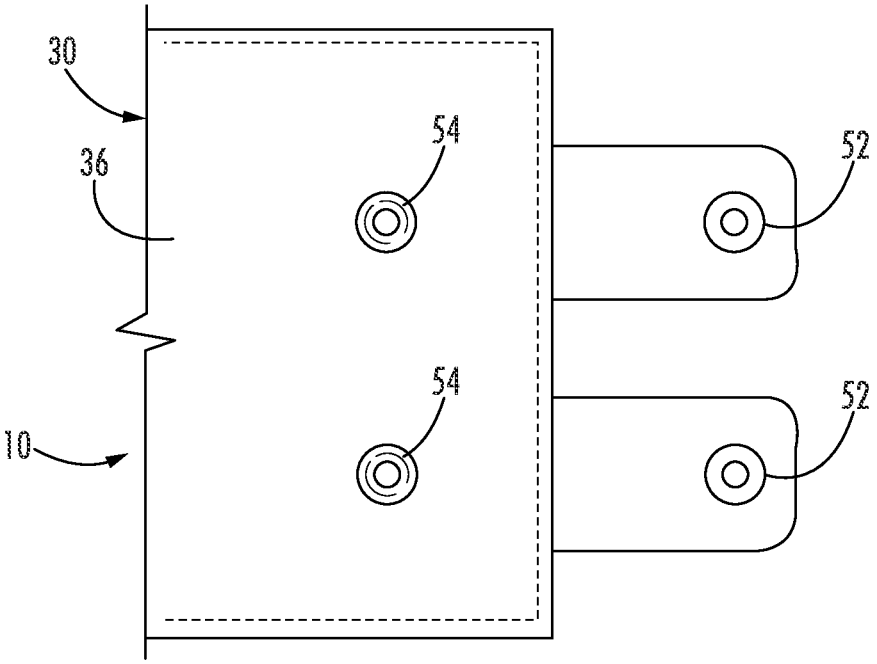
Figure 7:
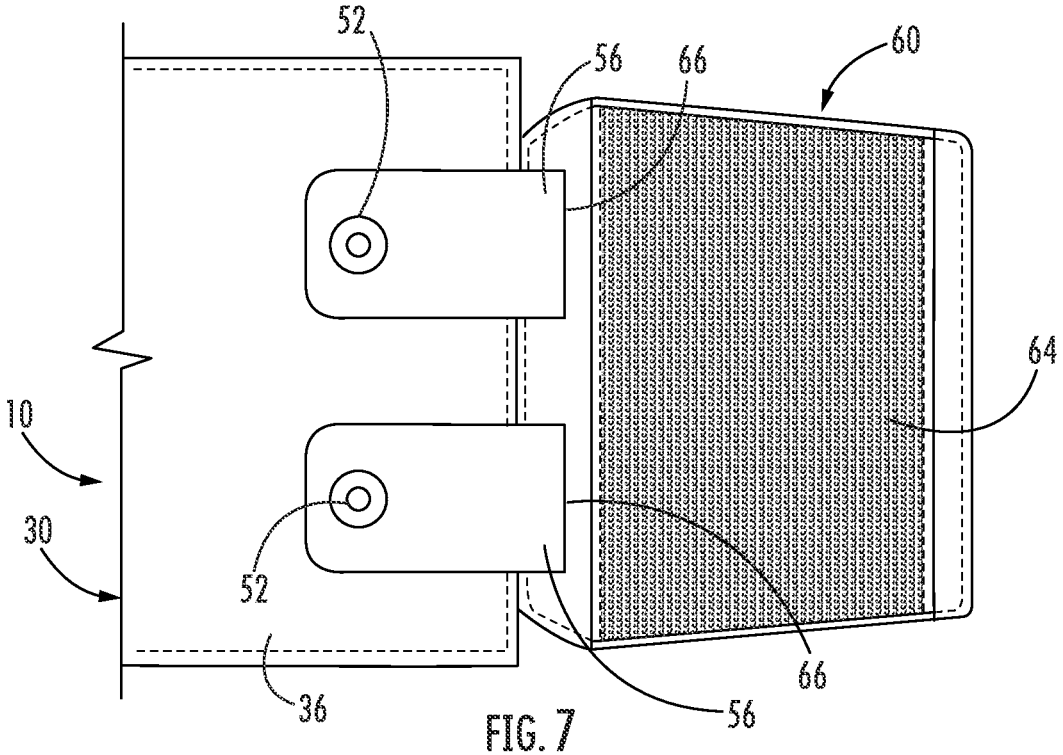
FIGS. 7 and 8 illustrate the connection of a hook and loop closure pad to the front panel via the strap end portions.

The cummerbund strap end portion 36 (FIG. 5) includes two projecting tabs 50 that form part of the adapter system 10. On the end of each tab 50 is the female portion 52 of a snap fastener. The tab also has a counterpart male snap fastener portion 54 located near the base of the tab. Each tab 50 can be curled around to that its male and female snap fastener portions 52 and 54 engage, to form a closed ring 56 extending from the strap end portion 36 (FIG. 7). These rings 56 on the strap end portions 36 can be used to secure and support a variety of strap end closure mechanisms, as described below.

Figure 8:
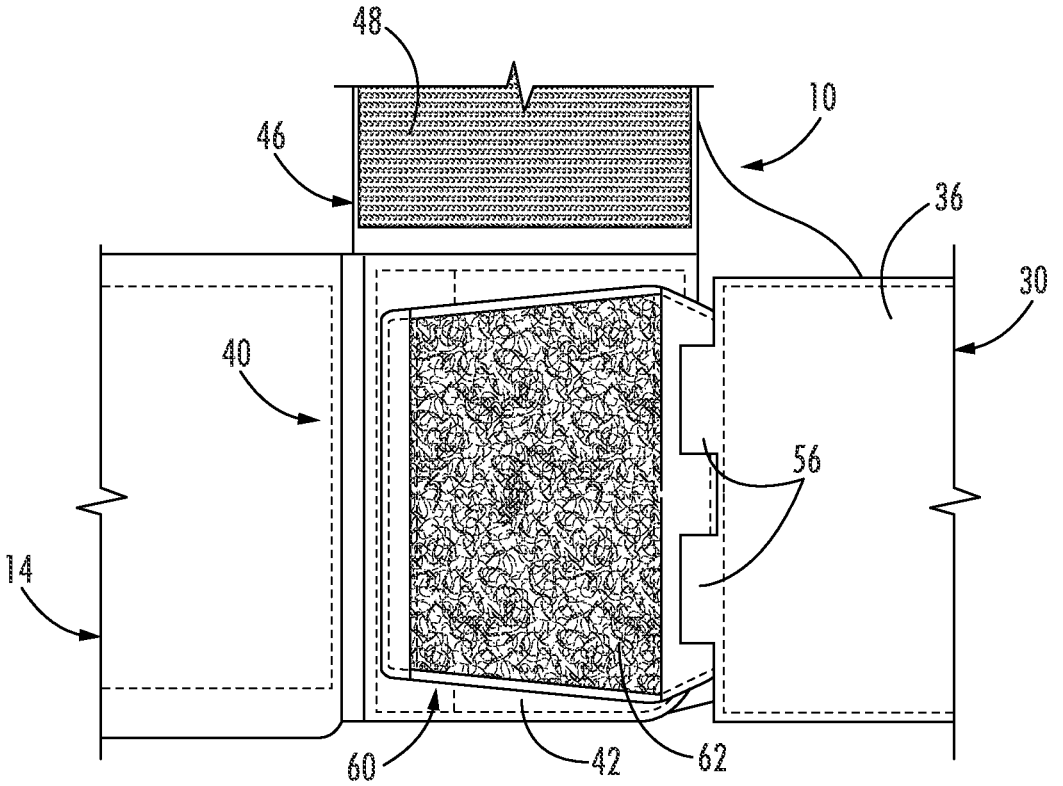

One closure mechanism part that can be placed on the rings is a hook-and-loop pad 60 (FIGS. 7-8). The hook-and-loop pad 60 has loop material 62 on its outwardly facing side and hook material 64 on its inwardly facing side. The pad 60 also has two slots 66 through which the rings 56 can be extended and secured. When this is done, the pad 60 is supported on the strap end portion 36 of the cummerbund 30, as shown in FIG. 7.

The pad 60 can then be placed in a position overlying the loop patch 42 on the engagement area 40 (FIG. 7). The hook material 64 on the inner side of the pad 60 engages the loop material 42 on the vest engagement area 40. Then the covering flap 46 is closed, and the hook material 48 on the inside of the covering flap engages the loop material 62 on the outside of the pad 60. As a result, the pad 60 is securely clamped between the front panel 14 of the vest 12 and the covering flap 46. Thus, the cummerbund end portion 36 is secured to the vest front panel 14.

This connection is releasable, by opening the covering flap 46 and removing the pad 60 from the loop patch 42 on the vest 12 front panel. This connection is also adjustable, by the user choosing the position of the pad 60 on the loop patch 42.

Thus it can be seen that the adapter system 10 enables use of a hook and loop closure mechanism, on the vest 12, to connect the vest front panel 14 with the cummerbund 30 and thus the vest rear panel 16.

Figure 9:
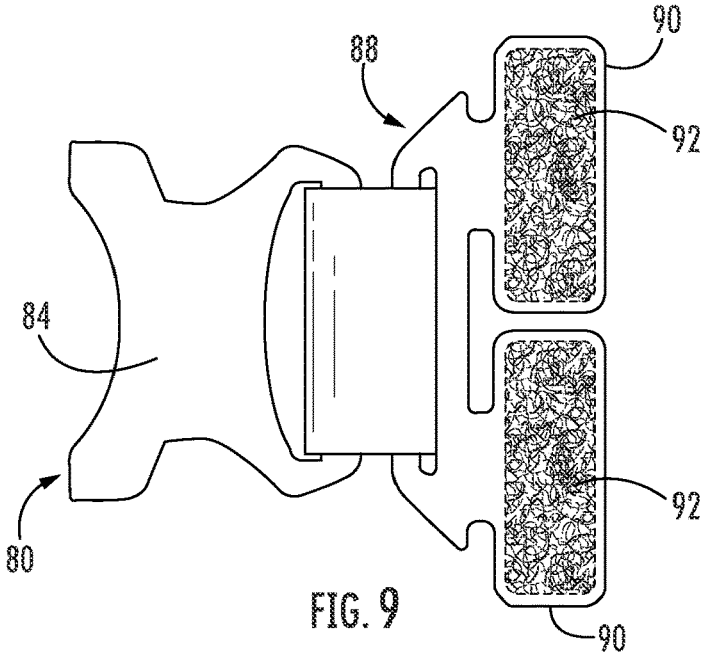
FIGS. 9 and 10 illustrate the connection of a quick release buckle to the front panel.
Figure 10:
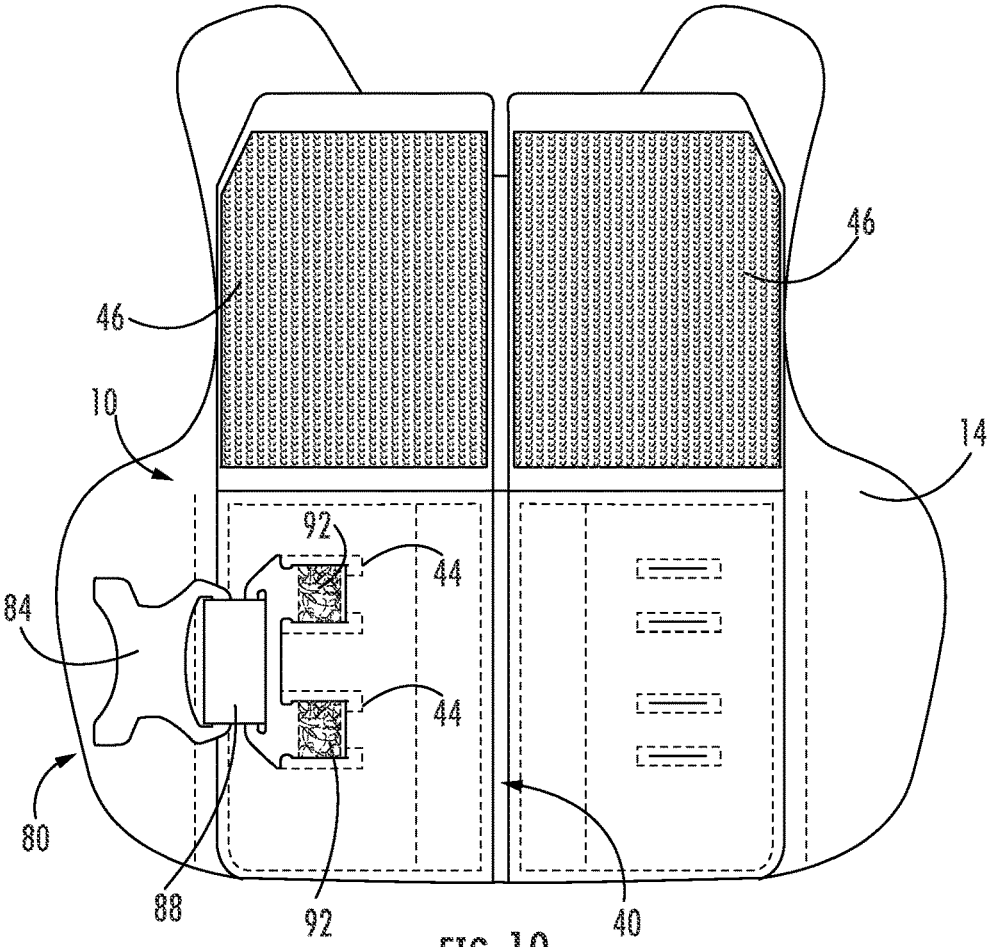
Figure 11:
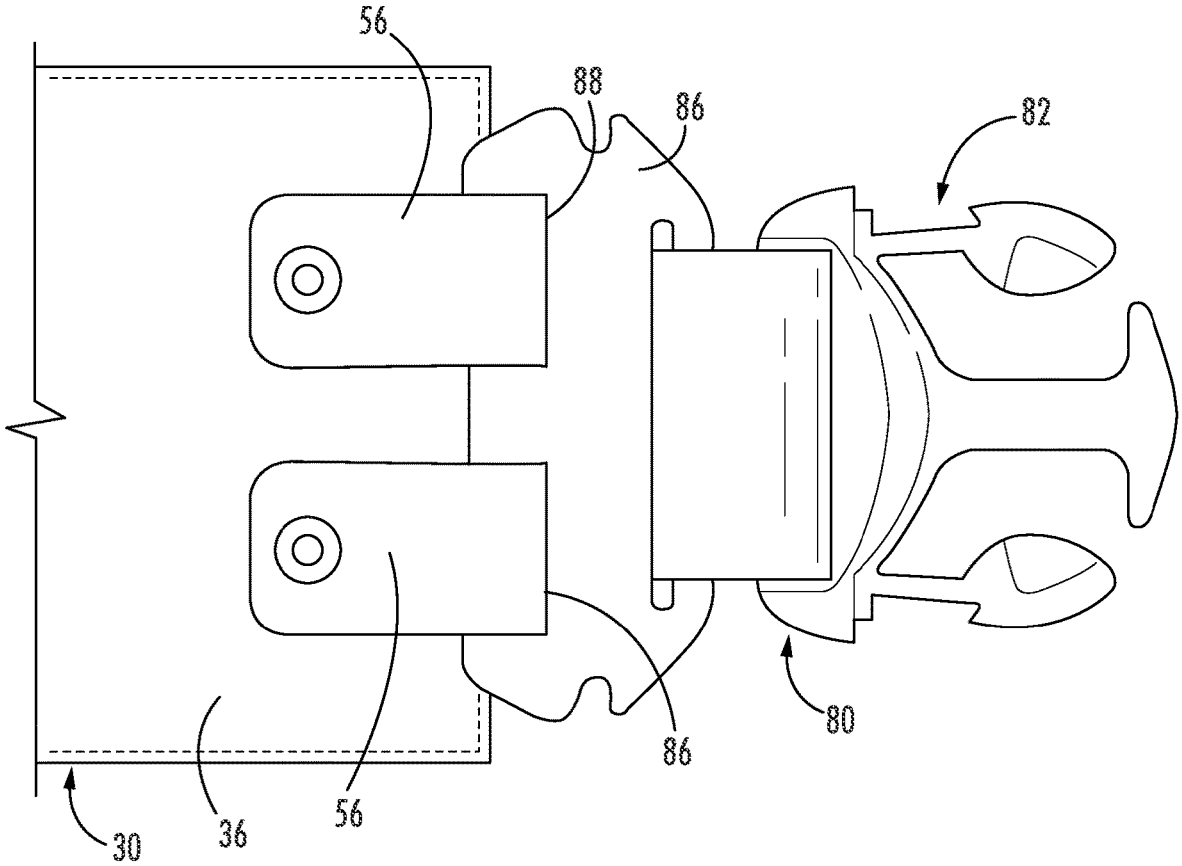
FIG. 11 illustrates the connection of a tongue that is engageable with the quick release buckle of FIG. 10, to the strap end portions.

FIGS. 9-11 illustrate a second, alternative, type of closure mechanism that can be used with the strap end portion 36 and engagement area 40 and thus with the adapter system 10. This closure mechanism is in the form of a buckle assembly 80 that includes a tongue 82 and a buckle 84. The tongue 82 is mounted on an element 86 having slots 88 for receiving the rings 56 of the strap end portion 36. The tongue 82 can thus be connected to the strap end portion 36 with the rings 56.

The buckle 84 is mounted on an element 88 having tabs 90 with loop material 92 on their outer surface. The tabs 90 can be inserted into and behind the fastening slots 44 of the vest front panel, to connect the buckle 84 to the vest front panel. Then the covering flap 46 is folded down over this assembly. The hook material 48 on the inside of the covering flap 46 engages the loop material 92 on the outer surface of the tabs 90 of the buckle element 88.

As a result, the buckle 84 is securely fastened to the vest front panel engagement area 40. The buckle 84 can then be engaged with the tongue 82 on the strap end portion 36, to make a secure, releasable connection between the vest front panel 14 and the back panel 16 via the cummerbund 30.

It can thus be seen that the front panel engagement area 40, with its hook pad 40 and fastening slots 44, is capable of receiving at least two different types of vest closure mechanisms—a hook and loop closure mechanism, and a tongue and buckle closure mechanism.

Figure 12:
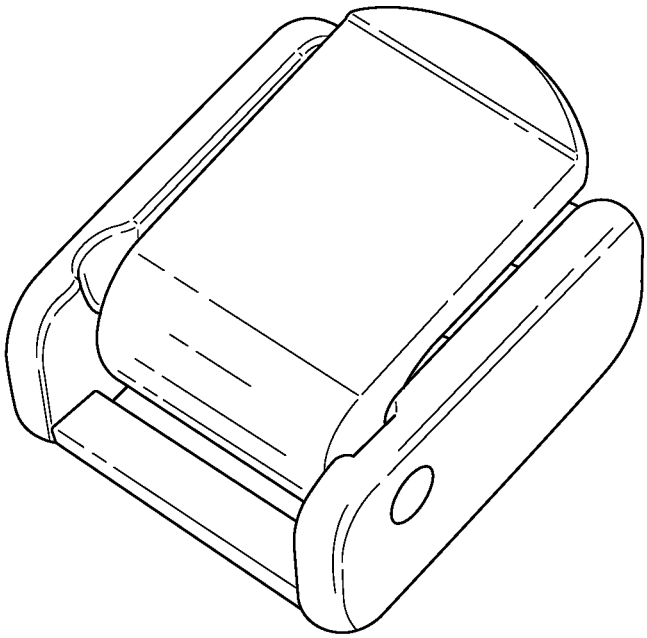
FIGS. 12 and 13 illustrate a cam buckle that can be used with the adapter system of the present invention.
Figure 13:
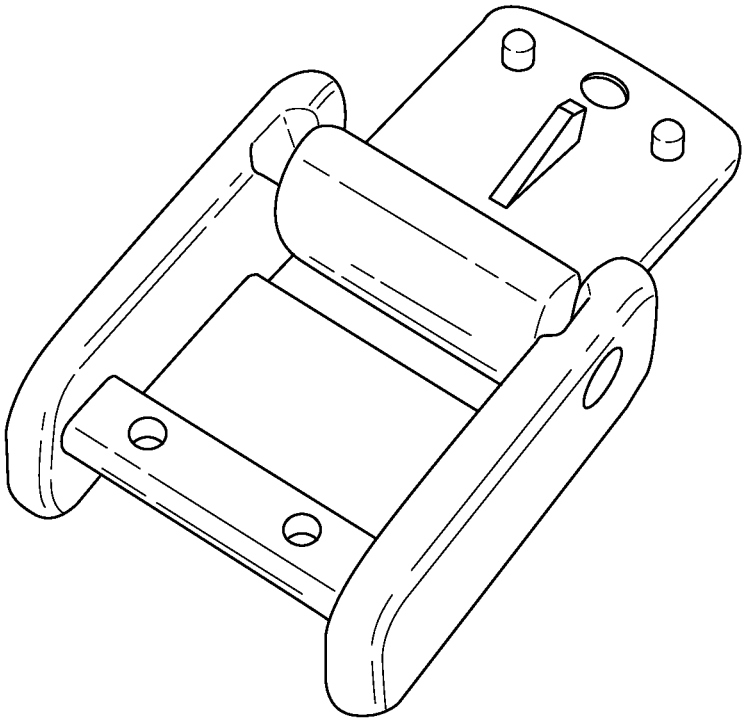
Figure 14:
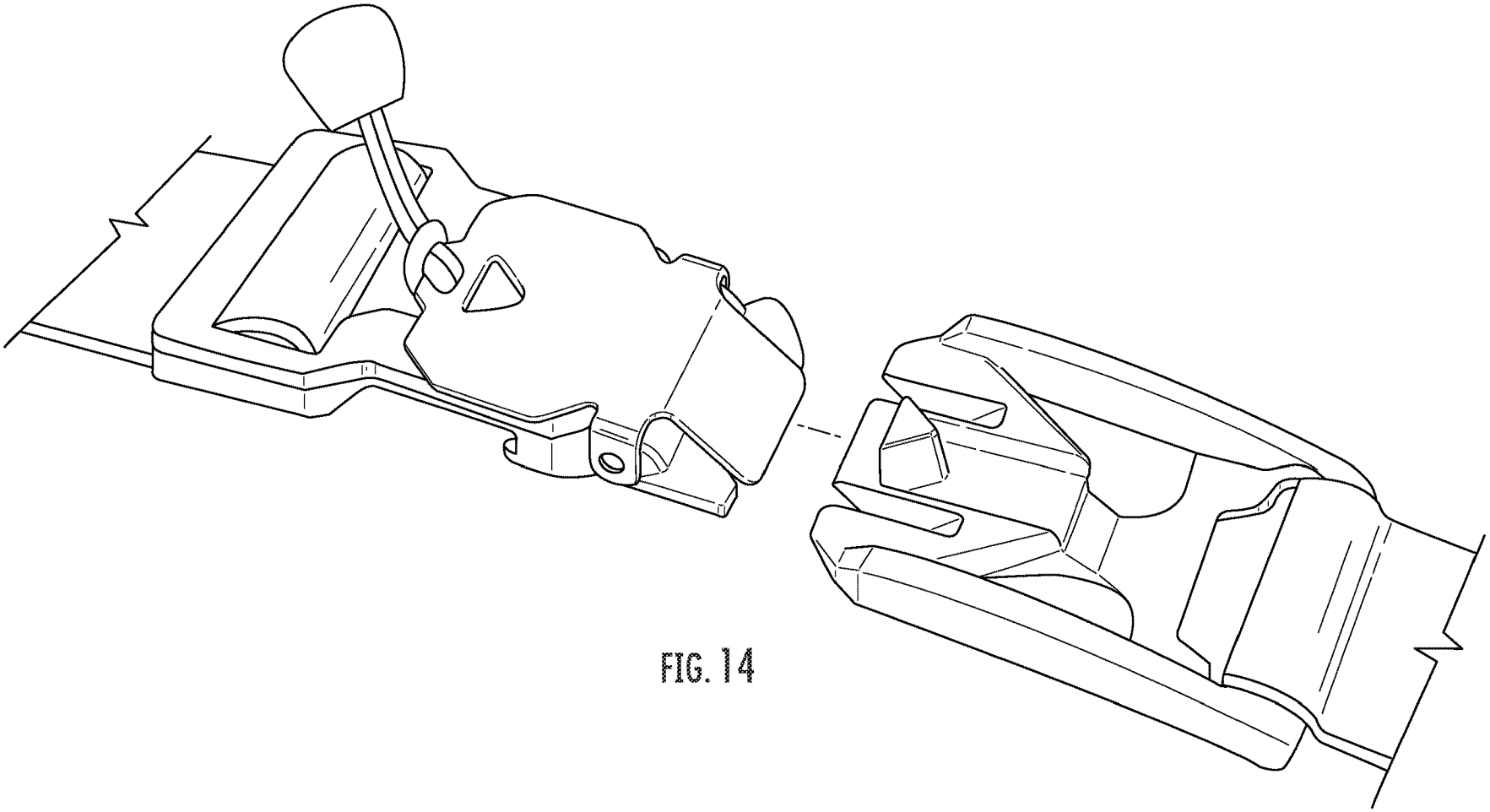
FIG. 14 illustrates a magnetic buckle that can be used with the adapter system of the present invention.
Figure 15:
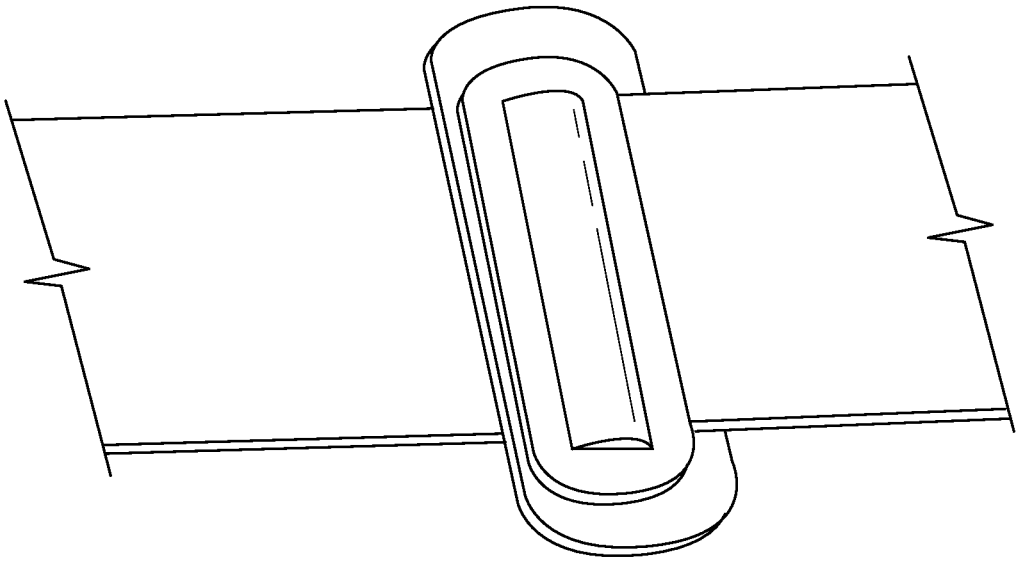
FIG. 15 illustrated a D-ring belt buckle assembly that can be used with the adapter system of the present invention.

Other types of closure mechanisms that can be used include, without limitation: cam buckles (FIGS. 12 and 13); magnetic buckles (FIG. 14); webbing straps and D-ring attachments (FIG. 15); fastening straps; and more. An adapter system 10 can be configured for any of these closure mechanisms, incorporating one or both of the hook and loop pad 40 and the fastening slots 44. Each adapter may include a way of connecting to the tabs 50 of the strap end portions 36, such as slots for receiving the tabs 50. Each adapter may also include one or more ways of connecting to the vest front panel engagement area, such as via the hook and loop connection or via the fastening slots 44. A one-part closure mechanism (such as the hook and loop pad 60) connects directly between the strap end portions 36 and the vest front panel engagement area. A two-part closure mechanism (such as the buckle assembly 80) has one part (in this case the tongue) connected to the strap end portions 36 and the other part (in this case the buckle) connected to the vest front panel engagement area.

The invention can be incorporated into almost any type of vest that has a front panel, a back panel, and some type of closure mechanism connecting them at the sides. As noted above, the vest front panel area may be connected with a cummerbund, which is a separate element centered on the back panel and having end portions that wrap around the side gaps to the front panel. Alternatively, the vest front panel may be connected with the back panels themselves if they have suitable portions that wrap around the side gaps to the front panel. The location of the engagement area under the covering flap also helps to protect and keep clean the engagement area.

Figure 16:
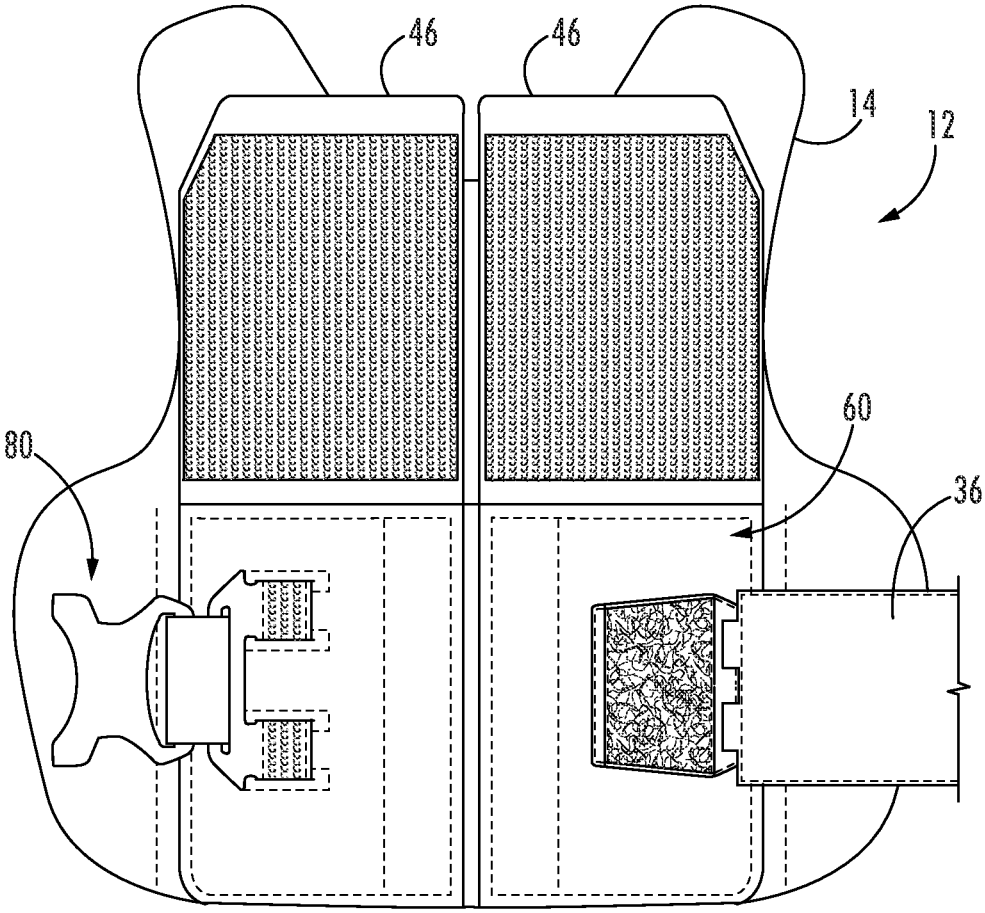
FIG. 16 illustrates the use of two differently configured connectors on opposite sides of the vest, by the adapter system.

In accordance with another aspect of the invention, a user may use one closure mechanism on one side of the vest, and a second (different) closure mechanism on the other side of the vest As one example (FIG. 16), a user may use a hook and loop pad 60 on one side of the vest, and a buckle assembly on the other side of the vest. This may be done, for example, if the user wants one of the sides to be quick release while the other side is more permanent.

The invention claimed is:

1. A side-opening ballistic vest having a closure mechanism adapter system, comprising:

a front panel and a back panel that are connected by shoulder straps and that are spaced apart from each other to thereby define a left side gap and a right side gap;

a first side strap connected with and extending from the back panel across one of the left side gap or the right side gap for connection with the front panel, the first side strap having a first front end portion;

a first connector element configured to be selectively connected to and selectively removed from the first front end portion of the first side strap, without removal of the first side strap from the back panel said first connector element having at least one first structure to which said first front end portion is configured to be secured, the front panel having a first engagement area for engagement by the first connector elesment thereby to connect the first side strap in a first manner with the front panel; and a second connector element configured to be selectively connected to and selectively removed from the first front end portion of the first side strap to replace the first connector element on the first side strap without removal of the first side strap from the back panel, the second connector element being configured for engagement with the first engagement area in a different manner than the first connector element, thereby to connect the first side strap with the front panel, said second connector element having at least one second structure to which said first front end portion is configured to be secured, wherein said closure mechanism adapter system enables swapping of one of said first connector element and said second connector element with the other of said first connector element and said second connector element without removal of the first side strap from the back panel.

2. A side-opening ballistic vest having a closure mechanism adapter system according to claim 1, wherein the first connector element includes a hook and loop closure assembly and the second connector element includes a buckle assembly.

3. A side-opening ballistic vest having a closure mechanism adapter system according to claim 1, wherein the buckle assembly includes a buckle and a tongue, a first one of the buckle and tongue is releasably securable on the first engagement area, and the second one of the buckle and tongue is releasably securable on the first side strap.

4. A side-opening ballistic vest having a closure mechanism adapter system according to claim 1, wherein the hook and loop closure assembly includes a first pad that is permanently secured on the first engagement area and a second pad that is releasably securable on the first side strap.

5. A side-opening ballistic vest having a closure mechanism adapter system according to claim 1, wherein the first engagement area includes at least one of a hook or loop pad, and further includes a vertically pivotable flap that is pivotable between an open position and a closed position, the flap including at least the other of a hook or loop pad engageable with the hook or loop pad on the first engagement area when in the closed position to close and cover the first engagement area.

6. A side-opening ballistic vest having a closure mechanism adapter system according to claim 1, wherein each of the first connector element and the second connector element includes at least one of a hook or loop connector pad that is engaged by the hook or loop pad on the flap when the flap is in the closed position, the connector pad being clamped between the hook or loop pad on the first engagement area and the hook or loop pad on the flap.

7. A side-opening ballistic vest having a closure mechanism adapter system according to claim 1, further comprising a second side strap connected with and extending from the back panel across the other of the left side gap or the right side gap for connection with the front panel, the second side strap having a second front end portion, the front panel having a second engagement area for engagement by the first or second connector elements thereby to connect the second side strap with the front panel wherein said first and second connector elements are selectively connected to and selectively removed from the second front end portion of the second side strap, without removal of the second side strap from the back panel.

8. A side-opening ballistic vest having a closure mechanism adapter system according to claim 7, wherein the second engagement area includes at least one of a hook or loop pad, and further includes a vertically pivotable flap that is pivotable between an open position and a closed position, the flap including at least the other of a hook or loop pad engageable with the hook or loop pad on the second engagement area when in the closed position to close and cover the second engagement area.

9. A side-opening ballistic vest having a closure mechanism adapter system according to claim 8, wherein each of the first connector element and the second connector element includes at least one of a hook or loop connector pad that is engaged by the hook or loop pad on the flap when the flap is in the closed position, the connector pad being clamped between the hook or loop pad on the second engagement area and the hook or loop pad on the flap.

10. A side-opening ballistic vest having a closure mechanism adapter system according to claim 1, said front end portion having at least one ring comprising at least one tab having a male fastening element and a female fastening element securable to said male fastening element, wherein when said female fastening element is secured to said male fastening element, said tab forms said at least one ring in a closed configuration, said at least one ring being selectively securable to said first structure and said second structure.

* * * * *